United States Patent [19]

Caporaso

[11] 4,399,157

[45] Aug. 16, 1983

[54] PACKAGING SYSTEM FOR FULLY BAKED, UNFILLED PASTRY SHELLS

[75] Inventor: John A. Caporaso, Hackensack, N.J.

[73] Assignee: Nabisco Brands, Inc., Parsippany, N.J.

[21] Appl. No.: 344,290

[22] Filed: Feb. 1, 1982

[51] Int. Cl.[3] ..... B65D 85/36

[52] U.S. Cl. ..... 426/108; 206/585; 206/594; 426/124; 426/128; 426/138; 426/556

[58] Field of Search ..... 426/128, 119, 108, 124, 426/138, 391, 556, 398, 496, 502; 206/585, 523, 584, 593, 594, 521

[56] References Cited

U.S. PATENT DOCUMENTS

| | | | |
|---|---|---|---|
| 1,102,191 | 6/1914 | Hammond | 206/585 |
| 1,792,303 | 2/1931 | Hitchins | 426/124 |
| 1,808,136 | 6/1931 | Gray | 206/594 |
| 1,882,524 | 10/1932 | Sherman | 426/124 |
| 2,111,021 | 3/1938 | Bemis | 426/556 |
| 2,180,465 | 11/1939 | Gelfand | 426/128 |
| 2,476,923 | 7/1949 | Sogas | 426/108 |
| 3,119,542 | 1/1964 | Pomerantz | 206/594 |
| 3,146,112 | 8/1964 | Weinstein | 426/124 |
| 3,190,758 | 6/1965 | Hauf | 426/391 |
| 3,212,907 | 10/1965 | Caprioli | 426/124 |
| 3,246,744 | 4/1966 | Marnon | 206/585 |
| 3,286,825 | 11/1966 | Laas | 206/594 |
| 3,288,278 | 11/1966 | Rich et al. | 426/128 |
| 3,379,536 | 4/1968 | Foss et al. | 426/119 |
| 3,392,902 | 7/1968 | Donovan | 426/124 |
| 3,406,856 | 10/1968 | Griffith et al. | 426/128 |
| 3,407,079 | 10/1968 | Griffith et al. | 426/397 |
| 3,441,418 | 4/1969 | Nishikiori | 426/556 |
| 3,492,127 | 1/1970 | Ketch et al. | 426/556 |
| 3,637,404 | 1/1972 | MacManus | 426/124 |
| 3,656,967 | 4/1972 | Barton et al. | 426/556 |
| 3,692,535 | 9/1972 | Norsby et al. | 426/556 |
| 3,710,931 | 1/1973 | Hollinger | 426/108 |
| 3,745,025 | 7/1973 | Hollinger | 426/128 |
| 3,835,994 | 9/1974 | Davis et al. | 426/128 |
| 4,082,187 | 4/1978 | Carlson | 426/108 |
| 4,265,919 | 5/1981 | Munter et al. | 426/138 |
| 4,323,585 | 4/1982 | Manser | 426/124 |

OTHER PUBLICATIONS

Food Engineering 12/55 p. 164.

*Primary Examiner*—Steven L. Weinstein
*Attorney, Agent, or Firm*—Richard Kornutik

[57] ABSTRACT

Disclosed is a packaging system capable of protecting the freshness and structural integrity of fully-baked pastry shells during shipping and storage. According to the disclosure: individual pastry shells, held in conforming baking pans, are placed in paperboard cartons; at least one stack of cartons is then enclosed by a bag comprised of high polymer film; shock absorbing material is positioned to totally surround the cartons; and a corrugated shipping container is employed to enclose the absorbing material, the bag, and the cartons.

7 Claims, 5 Drawing Figures

PACKAGING SYSTEM FOR FULLY BAKED, UNFILLED PASTRY SHELLS

BACKGROUND OF THE INVENTION

The present invention relates to packaging, and particularly to a packing system capable of protecting fully-baked pastry shells from the rigors normally associated with commercial shipping and distribution.

While the availability of fully-baked pastry shells increases the convenience for preparing desserts and main meal portions employing them, pastry shells are extremely fragile and are easily damaged during commercial handling. The proper design of a shipping container for fully-baked pastry shells must be capable of protecting one of the most fragile food products at reasonable costs.

According to one prior art attempt to package pie crusts, Griffith et al. in U.S. Pat. No. 3,407,079 packages graham cracker crusts, uncooked pie dough, or other prepared or partially prepared pastry products by packaging the individual crusts, maintained within metal baking pans, one on top of another, and holding a stack of crusts within a packaging receptacle which prevents movement of the stack within the receptacle. Compression of the individual crusts within the stack requires that the pans and the crusts retain sufficient resilience or spring so that they exert a counter thrust against the bottom and cover of the receptacle to assure that looseness will not develop after the package is completed. Packaging fully-baked pie or other pastry crusts in the nested relationship under compression as disclosed by Griffith et al would lead to unacceptably high levels of breakage caused by the packaging alone.

According to another prior art attempt at providing the convenience of formed pastry products at home, Munter et al. in U.S. Pat. No. 4,265,919 describe a frozen, pre-prepared shell packaged along with a food material containing a normally-liquid component. The shell is positioned over a centrally-depressed receptacle containing normally-liquid material by means of an outwardly and downwardly extending rim around the receptacle. As distributed, the pastry shell and the normally liquid material are frozen. To prepare the products for consumption, the combined package is heated to liquify the ingredients of the filling material, and the package is then inverted to permit the liquid ingredients to fill the pastry shell for final baking. While products of this type may offer a degree of convenience, they do not solve the basic problem of providing a simple and effective packaging system for protecting fully-baked pie crusts, not packaged with a filling material, against the repeated impacts and shocks under varying ambient conditions which are typical of commercial handling and distribution.

There remains a present need for a packaging system capable of protecting fully-baked pastry shells from structural damage or other deterioration from the point at which they leave the preparation site to the point at which they are unpacked for use.

SUMMARY OF THE INVENTION

It is an object of the present invention to provide an improved system for packaging fully-baked pastry shells.

It is yet another object of the present invention to provide a system for packaging fully-baked, shelf-stable pastry shells in a manner which assures their safe distribution and handling, but also provides the necessary degree of convenience to permit sale of shells as individual items.

It is yet another object of the present invention to provide an improved system for packaging pre-baked pastry shells, not containing a filling material, which protects them against the rigors of commercial shipping and handling from the time they leave the point of preparation until the time of final consumption.

These and other objects are accomplished according to at least the preferred embodiments of the present invention which provide a packaging system for protecting the freshness and structural integrity of a plurality of fully-baked pastry shells during shipping and storage, the system comprising: at least one stack of paperboard cartons, each carton containing a single pastry shell positioned within a conforming pan; a bag comprised of a high polymer film surrounding the stack of paperboard cartons; at least one layer of shock absorbing material surrounding the bag; and a corrugated shipping container enclosing the shock absorbing material. Thus, by virtue of the high degree of protection of the combined system, the individual pastry shells are fully protected until the point of sale. At that point, the individual paperboard cartons are removed from the other elements of the packaging system but still provide adequate protection for the fully-baked pie shell until final consumption. The combination of the high degree of protection along with practical convenience is a major advantage of the present invention.

BRIEF DESCRIPTION OF THE DRAWINGS

The invention will be better understood and its advantages will become more apparent when the following detailed description is read in light of the attached drawings wherein.

DETAILED DESCRIPTION

Figure 1:
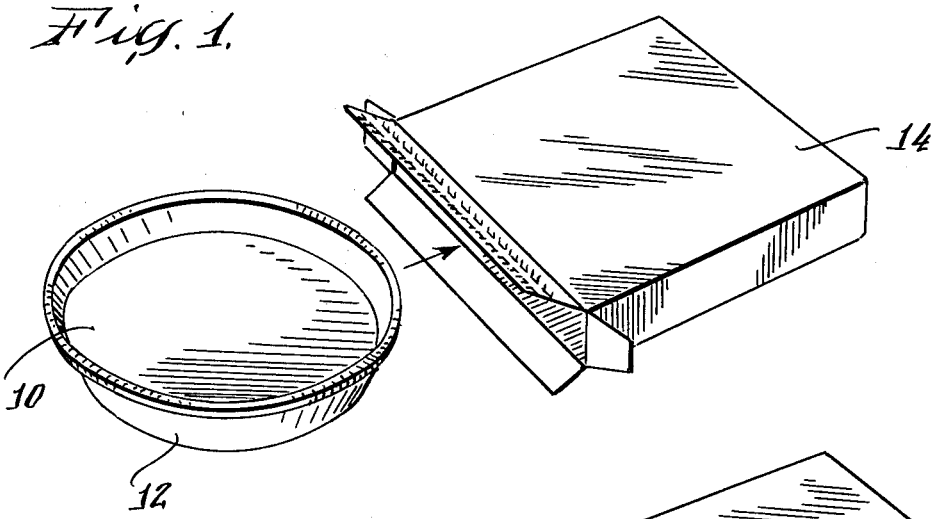
FIG. 1 is an exploded view in perspective showing the insertion of a single pastry shell to a paperboard carton.

FIG. 1 shows an individual pastry shell 10, maintained within a pan 12, being inserted within a paperboard carton 14. The carton 14 can be of any suitable construction, and is preferably of the type which has flaps that can be sealed and then re-opened by means of a zipper-type pull strip formed by selectively scoring the flaps. Preferably, the flaps are designed to have a reclosable feature. The particular paperboard material can be any one suitable for the purpose. One type of paperboard having been found effective is a 0.022 inch clay-coated news back, treated with an oil repellent such as Scotchban FC-807 Fluorochemical.

The pan 12 can be of any suitable construction, but preferably is constructed out of aluminum foil which is crimped to the desired size and shape. According to one particularly preferred embodiment, the pan will be constructed from 0.0045 inch thick aluminum foil, having a top outside dimension of 9⅝ inch, a top inside dimension of 8-23/32 inch, a bottom of 7 inches in diameter, and a vertical depth of 1⅛ inches. The particular dimensions are not critical to the invention; however, it is important for the pan to be sized such that the combination of shell 10 and pan 12 contacts each of the internal walls of the carton 14 to substantially limit movement of the shell within the carton. As an alternative to metal foils for constructing the pan 12, certain ovenable plastic materials, molded pulp or paperboard can be employed.

The pastry shell 10 will be unfilled according to the invention, and will therefore be extremely fragile. To reduce the degree of fragility of the crust, it should be free from any substantial discontinuities which would decrease its structural strength. Preferably, the crust 10 should have no cracks or docking holes. In other words, the pastry shell 10 will exhibit a substantially continuous surface, free of any significant weaknesses which would increase the chances of breakage. Typically, the pastry shell 10 will have a moisture content of less than about 4.0%, and preferably from about 1.5 to about 3.5%. To achieve an added degree of flexibility while still maintaining the low moisture content, up to about 5% of glycerol can be employed within the shell. Preferably, levels of glycerol of from about 2 to about 3% based upon the weight of the shell are employed. It has been found that the glycerol, in addition to improving the physical strength of the product, also maintains the flaky texture of the pastry shell over extended periods of storage.

Figure 2:
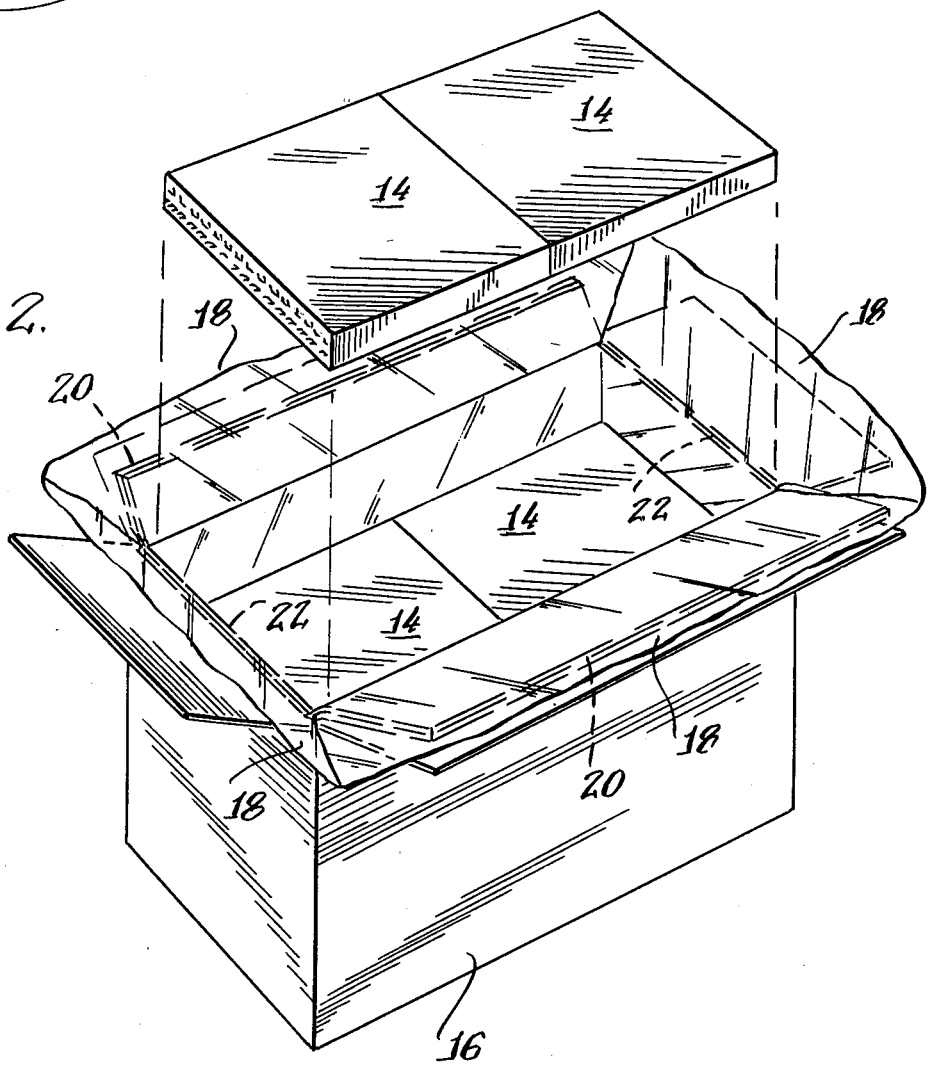
FIG. 2 is an exploded view showing the arrangement of the various elements of packaging system according to the invention.
Figure 3:
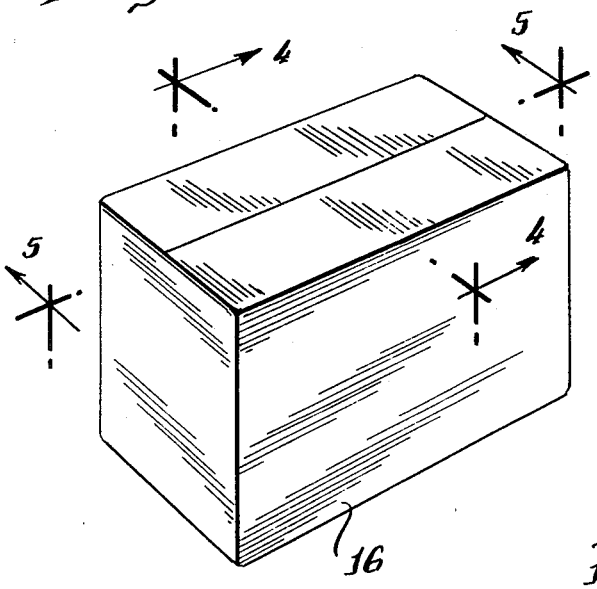
FIG. 3 shows the outward appearance, in perspective, of the completed packaging system to indicate the planes along which the sectional views of FIGS. 4 and 5 are taken.

The individual cartons 14 of the packaging system are stacked into at least one stack and then placed within the other elements of the packaging system. The embodiment shown in FIG. 2 shows two stacks of cartons 14 being placed within the corrugated shipping container 16 which has flat sheets of shock absorbing material, 20 and 22, positioned between the interior walls of the shipping container 16 and a bag 18 constructed of a high polymer plastic material which encloses the stacks of cartons 14. To totally enclose the cartons 14 and the other elements of the system within the shipping container 16, the remaining two cartons shown in FIG. 2 are placed within the bag 18, and the bag is then closed, preferably by heat sealing to make it airtight. Then, the upwardly extending flaps of shock absorbing material 20 are folded over the top of the enclosed bag and the shipping container 16 is sealed as shown in FIG. 3. The top seam 24 of the shipping container can be sealed by means of tape or simply with an adhesive as is known in the art.

The bag 18 for the packaging system which encloses the individual paperboard cartons is preferably of gusseted construction to permit it to be easily placed within the shipping container 16. While the particular type of high polymer material is not important according to the present invention, it is preferably a polyolefin such as high density polyethylene. In one particular embodiment, the film employed is a two mil thick high density polyethylene, having a gusseted bottom with ⅛ inch heat sealed seams. Because of the ability to heat seal the top and bottom portions of the bag, the freshness of the product in terms of flavor and moisture content are preserved over extended periods of time, typically greater than 6 months, and preferably greater than 9 months of shelf life.

Figure 4:
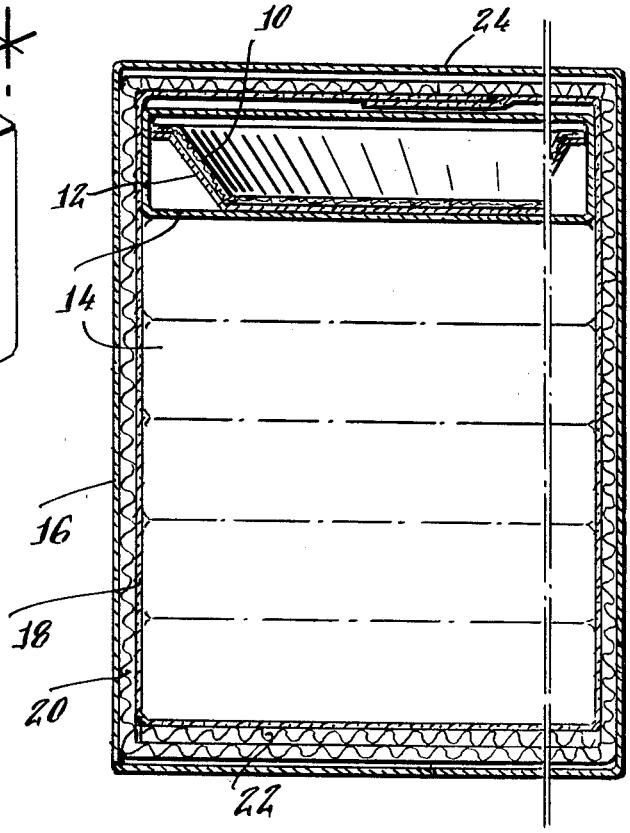
FIG. 4 shows a foreshortened sectional view of the packaging system of the invention taken along plane 4—4 in FIG. 3.
Figure 5:
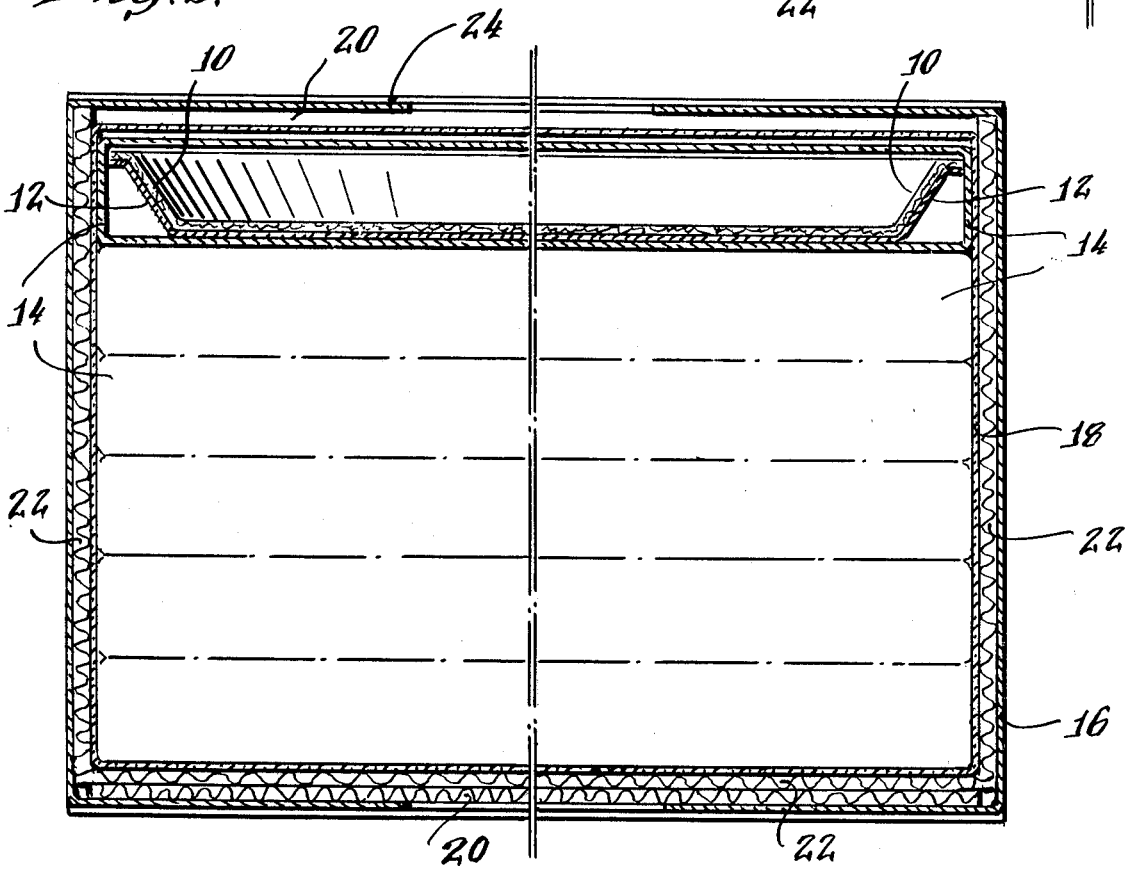
FIG. 5 shows a foreshortened sectional view of the packaging system taken along plane 5—5 in FIG. 3.

Reference to FIGS. 4 and 5, will provide a better understanding of one particular embodiment of the present invention, these foreshortened sectional views show the preferred arrangement of the various components of the packaging system from two different cross sections. FIG. 4 is a sectional view taken in the direction of the arrows in FIG. 3 along the plane indicated at line 4—4 therein, while FIG. 5 shows two stacks in a sectional view taken in the direction of the arrows in FIG. 3 along the plane indicated at line 5—5. Referring particularly to FIG. 4, it can be seen that there are two layers of shock absorbing material, 20 and 22, at the bottom of the corrugated shipping container 16. One of these layers, 20, extends from the inside top of the shipping container 16 around the bag-enclosed cartons on two inside walls of the shipping container, and also covers the bottom. In other words, sheet 20 surrounds four sides out of the six sides of the array of stacked paperboard cartons. A second sheet of shock absorbing material, 22, extends around the remaining two interior side walls of the shipping container and provides a double thickness at the bottom where the greatest protection will be required.

While any type of shock absorbing material which is available in sheet form and is capable of providing an adequate degree of protection can be employed, the preferred form of shock absorbing material comprises a cellulose wadding which is essentially a kraft paper having a three dimensionally formed undulating configuration is employed in a plurality of layers, typically about 4 to 6. One particular type of cellulose wadding which has been found to be effective according to the present invention is available under the trademark Jiffy Kushion Kraft 051 from Jiffy Packaging Corp. This particular material has five layers held together as a single sheet by mechanical interlock. This material provides good shock absorbing capability and resilience.

The corrugated shipping container 16 is preferably constructed of what is known in the art as a 200-pound C-fluted kraft corrugated board. Essentially, this material comprises two outer kraft paper liners separated by an internal layer of continuously fluted kraft paper.

As shown in FIG. 5, there are two stacks of cartons 14 maintained within a sealed bag 18 of high polymer film which is then cushioned from the exterior of the shipping container 16 by two sheets, 20 and 22, of shock absorbing material, one sheet, 20, covering four sides of the stacked array of cartons 14 while the other sheet, 22, protects three sides.

The packaging system of the present invention, when constructed as described and shown herein, provides extremely good protection for fully-baked, shelf-stable pastry crusts from the abuse occurring during normal shipping and handling. The pie or other pastry shells reach their point of distribution to the consumer, with a substantial degree of protection provided by the individual cartons 14 which maintained the pastry shells 10 within the pie pan 12 preventing substantial movement thereof within the individual cartons 14.

The above description is for the purpose of teaching the person skilled in the art how to practice the present invention. This description is not intended to teach each and every obvious modification and variation thereof which will become apparent upon reading. It is intended, however, that each such modification and variation will be included within the scope of the invention which is defined by the following claims.

What is claimed is:

1. A packaging system for protecting the freshness and structural integrity of a plurality of fully-baked pastry shells during shipping and storage, the system comprising:

at least one stack of paperboard cartons, each carton being an individual point of sale package, each carton containing a fully-baked, unfilled pastry shell, having a moisture content of less than about 4%, having a substantially continuous surface, and containing from about 2% to about 5% glycerol, positioned within a pan such that the combination of the shell and the pan contacts each of the internal walls of the carton to substantially limit the movement of the shell within the carton;

a bag comprised of a high polymer film surrounding the stack of paperboard cartons;

at least one layer of shock absorbing material surrounding the bag; and a corrugated shipping container enclosing the shock absorbing material.

2. A packaging system according to claim 1 which comprises at least two stacks of paperboard cartons, each stack containing from 4 to 8 cartons.

3. A packaging system according to claim 1 wherein each pan comprises aluminum foil sized such that the pan containing the pastry shell contacts each of the internal walls of the carton to substantially limit movement of the shells within the cartons.

4. A packaging system according to claim 1 wherein the cushioning material comprises a plurality of layers of cellulose wadding.

5. A packaging system according to claim 4 wherein the cushioning material is comprised of two flat sheets folded over the bag; one sheet extending over the bottom and two side walls of the interior of the shipping container; and the other sheet extending over the bottom, the other two side walls, and the top of the interior of the shipping container.

6. A packaging system according to claim 1 wherein the bag comprises high density polyethylene.

7. A packaging system according to claim 6 wherein the bag is heat sealed to form a continuous airtight closure.

* * * * *